United States Patent [19]

Munro

[11] 3,981,826

[45] Sept. 21, 1976

[54] HARD SURFACE CLEANING COMPOSITION

[75] Inventor: Hamish David Munro, St. Albans, England

[73] Assignee: The Procter & Gamble Company, Cincinnati, Ohio

[22] Filed: Nov. 25, 1974

[21] Appl. No.: 526,647

Related U.S. Application Data

[63] Continuation of Ser. No. 304,868, Nov. 8, 1972, abandoned.

[30] Foreign Application Priority Data

Nov. 15, 1971 United Kingdom ..... 52874/71

[52] U.S. Cl. ..... 252/526; 252/139; 252/140; 252/163; 252/164; 252/317; 252/531; 252/532; 252/534; 252/536; 252/539; 252/545; 252/550; 252/551; 252/553; 252/555; 252/558; 252/DIG. 14

[51] Int. Cl.[2] ..... C11D 1/12; C11D 3/04; C11D 3/12

[58] Field of Search ..... 252/140, 139, 154, 164, 252/532, 534, 539, 124, DIG. 14

[56] References Cited

UNITED STATES PATENTS

| | | | |
|---|---|---|---|
| 2,864,770 | 12/1958 | McCune et al. | 252/139 X |
| 2,940,938 | 6/1960 | Blinka | 252/309 |
| 2,945,815 | 7/1960 | Diaz | 252/539 |
| 3,210,285 | 10/1965 | Gangwisch | 252/539 X |
| 3,522,188 | 7/1970 | Cambre | 252/112 |
| 3,630,929 | 12/1971 | van Dijk | 252/136 |

FOREIGN PATENTS OR APPLICATIONS

| | | |
|---|---|---|
| 797,119 | 6/1958 | United Kingdom |
| 1,205,711 | 9/1970 | United Kingdom |
| 288,214 | 2/1971 | U.S.S.R. |

*Primary Examiner*—P.E. Willis, Jr.
*Attorney, Agent, or Firm*—Forrest L. Collins; Louis G. Xiarhos; Steven J. Goldstein

[57] ABSTRACT

Water-soluble non-aqueous liquid pasty or gelatinous detergent compositions having scouring properties are described and comprise a dispersion in a water-miscible liquid medium of a normally-solid water-soluble anionic surface-active agent, a solid particulate water-soluble inorganic salt and a suspending agent. The compositions provide scouring properties when employed in undiluted form or dish-washing or hard-surface cleaning properties when employed in a dissolved form.

16 Claims, No Drawings

HARD SURFACE CLEANING COMPOSITION

This is a continuation of application Ser. No. 304,868 filed Nov. 8, 1972, now abandoned.

This invention relates to substantially non-aqueous liquid or pasty gelatinous detergent compositions, capable of acting as scouring agents when applied neat to hard surfaces, but also capable of behaving as typical, water-soluble dishwashing compositions or as non-abrasive hard surface cleansers and the like when in aqueous solution.

Present day liquid dish-washing detergent products intended for manual dish washing are usually clear, or sometimes opacified, non-abrasive high sudsing compositions containing a high concentration, i.e. often approaching 50% by weight, of usually mainly anionic organic detergents, dissolved in an aqueous medium also containing solvents such as lower alcohols, and hydrotropes. These products are at best good grease-lifting and emulsifying agents, and they are fairly effective in removing soft deposits from surfaces, with the help of a little rubbing, for example using a dish mop. Harder more strongly adherent soil, such as burnt fat, sugar, etc. especially on cooking utensils and the like is not completely removed, and abrasive tools such as wire wool and the like often need to be used.

For cleaning, primarily fixed hard surfaces such as paint, baths, cookers, sinks, etc., considerably different classes of formulations are marketed. These are often solid, but sometimes are liquid or pasty. There are two main classes of these formulations, both containing quite low levels of organic surfactant. In one class, the products usually contain high levels of mildly alkaline inorganic salts, and are intended to be dissolved in water, and the solution used for washing down hard surfaces with, for instance a cloth. In the other class, the products usually contain high levels of water-insoluble abrasives, such as feldspar, silica or pumice. These compositions act as scourers, and they are liable to be rather harsh to glossy surfaces. When the abrasive used is insoluble, treated surfaces require thorough rinsing.

SUMMARY OF THE INVENTION

The present invention provides liquid detergent compositions which are scouring products when applied in concentrated or substantially concentrated form to surfaces, but which are essentially completely soluble in water. They can be formulated so that when dissolved in water they behave as typical dish-washing products or as typical non-abrasive hard-surface cleaners. Thus, if applied in concentrated form on a dry or damp cloth, they can be used to scour off most types of stains or deposits from surfaces of dishes, pots and pans or from cookers, sinks, baths, etc., yet they are easily rinsed off, leaving no insoluble deposit, and provide typical detergent solutions for washing surfaces or parts of surfaces which do not need scouring.

According to the invention, a substantially nonaqueous liquid or gelatinous detergent composition having scouring ability comprises a dispersion, in a water-miscible liquid medium, of a normally-solid (as hereinafter defined) water-soluble anionic surface active agent, a solid particulate water-soluble inorganic salt and a suspending agent (as hereinafter defined).

The term "substantially non-aqueous" is used herein to include compositions containing not more than about 5% water, apart from that present as water of crystallization.

DETAILED DESCRIPTION OF THE INVENTION

The anionic surface active agents may be any which are "normally-solid", that is, solid at room temperature in the pure state. Examples of such compounds are the sodium or potassium alkyl sulfates having 8 to 20 carbon atoms, preferably those having 8 to 14 carbon atoms; their ethylene-oxy derivatives having 1 to about 15 ethoxy groups, especially those having about 1 to 5 ethoxy groups, and the alkyl chains mentioned above; alkyl benzene sulfonates, with linear alkyl groups of from 8 to 20 and preferably 8 to 15 carbon atoms, especially about 12; alkene sulfonates, derived from olefins having 8 to 14 carbon atoms; alkali metal alkyl glyceryl ether sulfonates where the alkyl has from 8 to 20 carbon atoms; and others well known in the art. Ammonium or amine salts can be used if they are normally solid, as defined above. The preferred anionic surface-active agents are mixtures of sodium dodecylbenzene sulfonates and coconut or similar alkyl triethoxy sulfates in a molar ratio within the range from about 3:1 to 1:3, especially about 1:1.

Nonionic or zwitterionic surface-active agents, which need not be liquids, can be incorporated in the compositions. In products intended to be high-sudsing dishwashing liquids, the most usual nonionics incorporated are the fatty acyl ethanolamides, added primarily as suds stabilizers. In products intended to be used as hard surface cleansers, nonionics of the following classes can be incorporated: polyoxyethylene condensates on fatty alcohols, fatty acids, alkyl phenols, polypropylene oxides, sorbitan esters or mixtures thereof with fatty acid mono- or di-glycerides, and the like. Usually these substances have a suds-depressant effect, and some of them have good grease-lifting and emulsifying properties. Examples of suitable zwitterionic surfactants include 3-(N,N-dimethyl-N-hexadecylammonio)propane-1-sulfonate and 3-(N,N-dimethyl-N-hexadecylammonio)-2-hydroxy-propane-1-sulfonate. Usually these additional surface-active agents are present in an amount which is less than the amount of anionic surface active agents present, i.e., the anionic surface-active agent comprises at least about 50% of the surface-active agent content.

The inorganic salt or salts which are insoluble or at least substantially undissolved in the composition act as the abrasive agent. Any inorganic salts which are effective and otherwise acceptable in detergent compositions may be used. Preferably the salts should be in the form of discrete solid particles, rather than agglomerates of finer particles, but if they do consist of agglomerates, these should be such that they do not disintegrate or soften in the composition. The particles should be neither too coarse, nor too fine so as to be effective as abrasives, but still uniformly dispersible in a fluid and capable, preferably, of passing through the nozzle of an ordinary squeeze bottle. Thus they should normally be such that at least about 90% by weight passes through an 8 mesh BSS Test Sieve, and is retained by a 100 mesh, and preferably they are at the coarser end of this range, i.e. such that at least about 90% passes through a 10 mesh BSS Test Sieve and is retained by a 60 mesh. Preferred salts are sodium chloride or sesquicarbonate, or the corresponding potassium salts, but other water-soluble chlorides, sulfates, phosphates, carbonates, borates and the like may be employed if obtainable in suitable physical form.

For cleaning relatively porous hard surfaces, such as paint, or, especially, linoleum and like floor coverings, one of the more alkaline salts is preferable to a neutral salt such as sodium chloride.

The dispersing medium is a water-miscible liquid, in which the anionic surface-active agent may or may not be soluble, and in which the inorganic salt is at most only poorly soluble. It is also selected so as to control the final viscosity of the composition. Suitable substances are liquid polyhydric alcohols, such as glycerol, ethylene glycol and the like, optionally mixed with a proportion of a lower monohydric alcohol such as ethanol, or methanol, isopropanol, etc. A mixture of glycerol and ethyl alcohol in proportions by weight within the range from about 3:1 to 1:1, especially about 2:1 is preferred.

In order to ensure that the undissolved inorganic salt remains suspended in the liquid medium for considerable periods of time, it is necessary to include a small amount of suspending agent. This is a substance which affects the rheological properties of the liquid, either merely thickening it or, preferably, conferring Bingham plastic character, so that a definite shear force is necessary to initiate flow, and that this force is greater than that tending to cause sinking or floating of the inorganic salt or other undissolved material in the composition. Suitable agents include highly-voluminous oxides such as silica, magnesia, alumina or clay like substances. A preferred agent is a highly-voluminous silica sold under the Trade Name "Aerosil". By "soluble" and "effectively soluble" in this specification, it is intended to include substances such as "Aerosil", which are not strictly soluble but form colloidal solutions or pseudosolutions. The amount to be used is preferably in the ranges indicated below, the exact amount being selected so as to give a suitable degree of suspending power, and desirable viscosity, etc. in any given formulation.

The ranges of the components in the compositions can vary widely according to what class of product is intended. The preferred compositions are dish washing compositions, and these are conventionally high-active (organic detergent) products. Suitable compositions according to the invention for this purpose can have formulae in the ranges by weight:

| | | | |
|---|---|---|---|
| Organic surface-active agent | 15–74% | preferably | 20–40% |
| Inorganic salt (scourer) | 5–60% | " | 15–30% |
| Non-aqueous liquid medium | 19–79% | " | 30–60% |
| Suspending agent | 1–5% | " | 1–3% |
| Water | up to 5% | " | up to 4% |

In compositions intended as liquid hard-surface cleansers, suitable ranges are:

| | | | |
|---|---|---|---|
| Organic surface-active agent | 1–15% | preferably | 5–10% |
| Inorganic salt (scourer) | 5–60% | " | 15–30% |
| Non-aqueous liquid medium | 25–90% | " | 50–70% |
| Suspending agent | 1–5% | " | 1–3% |
| Water | up to 5% | " | up to 4% |

In compositions of a gelatinous nature, such as might be dispensed from a collapsible tube, the proportion of liquid medium may be reduced, or more viscous liquid employed, or higher proportions of suspending agent may be used.

The compositions can contain non-abrasive inorganic salts, for instance finely-divided sodium sulfate formed in preparing the anionic surface-active agents. These salts may or may not be dissolved. The compositions can also contain the usual minor components of detergent compositions of their type, such as bactericides, tarnish inhibitors, enzymes, bleaching or oxidizing agents, colors, perfumes, or the like.

The compositions of the invention can be prepared in any suitable manner, for instance by simply mixing together the components. It is preferable to take separately or mixed together the acid form(s) of the anionic surface active agent(s), for instance the acid mix or mixes derived from a sulfonation and/or sulfation process. This is neutralized by mixing it into a mixture of solid or highly concentrated aqueous caustic soda, glycerol or like and lower alcohol in appropriate proportions. Minor components and the suspending agent may then be added, and finally the particulate inorganic salt is added. In this method of preparation, it is convenient but not essential to add a little water to dissolve the caustic soda, and some water is formed in the neutralization of the acids, but the total amount is less than about 5% of the composition and can be tolerated.

The present invention includes a method of scouring hard surfaces which comprises applying thereto the composition of the invention in concentrated form.

The invention also provides a method of washing dishes which comprises applying thereto the composition of the invention in the form of an aqueous solution.

The following Examples illustrate the invention:

EXAMPLE I

Alkyl ($C_{12}$) benzene sulfonic acid (140.5 g.) and alkyl ($C_{12}/C_{14}$) triethoxy sulfuric acid (142 g.) were successively added, with stirring and cooling, to a neutralizing medium prepared by dissolving sodium hydroxide (31.5 g.) in water (16 g.), and dispersing this concentrated solution in a mixture of glycerol (290 g.) and ethyl alcohol (140 g.). Molten $C_{12}$ fatty acid monoethanolamide (20 g.) was dissolved into this mixture. "Aerosil" (20 g.) was then dispersed into the mixture to give a base liquid capable of suspending a solid abrasive powder.

To this base liquid was added a 200 g. quantity of a soluble solid scouring powder, viz. (a) sodium chloride (screened through 22 on 30), or (b) sodium sesquicarbonate (screened through 22 on 30), to give two examples of the invention.

In each case, a pourable liquid suspension was obtained which did not settle out appreciably over a period of at least 2 weeks.

| The final composition comprised: | % |
|---|---|
| NaLAS | 15 |
| $NaAE_3S$ | 15 |
| $C_{12}$amide | 2 |
| Glycerol | 29 |
| Ethyl alcohol | 14 |
| Water | 3 |
| Aerosil | 2 |
| Salt | 20 |
| | 100 |

These compositions, when added to water at a 0.2% product concentration, gave a high-sudsing detergent solution suitable for washing up after a typical family meal.

Used in concentrated form, the compositions were capable of removing burnt-on food, for example milk, egg or gravy. To demonstrate this ability, aluminum tiles were coated with milk/egg which was then baked on to form an adherent layer. Removal was effected by rubbing the tiles with the concentrated scouring product on a damp cloth, using 20 rubs in each case. The results are tabulated below.

| Product | | % Soil removed |
|---|---|---|
| Control | (no scourer) | 8 |
| Example | (a) | 62 |
| | (b) | 71 |

samples are quoted. Results with an asterisk were not distinguishable with 95% confidence above the random error of the test, which was carried out according to a statistical design involving 8 replicates.

Scouring Cleaning Test

Aluminum tiles were coated with a milk/egg mixture which was baked on to form an adherent layer. A dividing tape was placed in the middle along the length of the solid face of the tile. One side was scoured with a dish cloth on which a standard amount of a detergent composition of the invention had been placed. The number of rubs necessary partially to remove the soil layer, so as to leave about half the soiled area clean to bare metal was noted. The other side was treated similarly with a reference detergent and given the same number of rubs. The plates were then judged visually for comparative cleanliness of the two sides by a panel of judges, employing a 9 step ranking scale of

| Formulation No. | $AE_3S$ | LAS | Amide | Formulation Aerosil | Sodium Chloride | I.M.S. | Glycerol | Cylinder Suds quoted relative to commercial dishwashing liquid = 100 Suds | Mileage | Scouring/Cleaning Test quoted as Scheffe units win against a. Dishwashing Liquid | b. Scouring Powder |
|---|---|---|---|---|---|---|---|---|---|---|---|
| 1. | 8% | 24% | 2% | 2% | 25% | 14% | 25% | 545.8 | 256.3 | 2.61 | 2.49 |
| 2. | 30% | 30% | 2% | 2% | 15% | 7% | 14% | 945.8 | 362.5 | 2.31 | 0.67* |
| 3. | 15% | 15% | 2% | 2% | 5% | 20% | 41% | 475 | 225 | 1.25 | −1.25* |
| 4. | 15% | 15% | 2% | 2% | 25%[a] | 13% | 28% | 254.2* | 200 | 2.37 | 1.11* |
| 5. | 7% | 7% | 2% | 2% | 50% | 10% | 22% | 132.6* | 126.3 | 3.49 | 3.05 |
| 6. | 15% | 15% | 2% | 5% | 25% | 13% | 25% | 455.8 | 226.3 | 3.37 | 1.67 |
| 7. | 24% | 8% | 2% | 2% | 25% | 14% | 25% | 414.1 | 200 | 2.75 | 2.67 |
| 8. | 15% | 15% | 2% | 2% | 25% | 13% | 28%[b] | 453.3 | 205.3 | 3.55 | 3.17 |
| 9. | 3% | 3% | 1% | 2% | 25% | 22% | 44% | — | — | 2.93 | 2.01 |
| 10. | ½% | ½% | ½% | 2% | 25% | 23% | 48% | — | — | 2.67 | 2.41 |

[a]Sodium carbonate in place of Sodium Chloride
[b]Propylene glycol in place of glycerol
*Indicates difference not significant within the confines of the test
$AE_3S$ = Sodium salt of $C_{12}/C_{14}$ alkyl triethoxy sulfate
LAS = Sodium dodecylbenzene sulfonate
Amide = Lauric monoethanolamide
I.M.S. = Industrial Methylated Spirits (95 volumes ethanol, 5 volumes naptha)

EXAMPLE II

The table below lists a number of compositions according to the invention, together comparisons of their sudsing in the presence of soil load with that of a typical dishwashing liquid, and comparisons of their ability to remove a typical adherent dishwashing soil with that of the same dishwashing liquid and of a typical scouring powder based upon insoluble siliceous abrasive.

Suds Test

Solutions were prepared of compositions according to the invention and of the typical dishwashing liquid, of concentration 0.15% by weight in medium hard water (172 ppm as Ca $CO_3$) at 45°C. 100 cc of each solution were placed in stoppered 500 cc measuring cylinders, together with 1 cc of a simulated dishwashing soil. The cylinders were placed in a device in which two or more could be rotated end over end side by side. They were rotated for standard time, and the machine was then stopped and the suds height was recorded. A further dose of soil was added and the procedure repeated as often as necessary until the suds height was reduced to a slight covering (2 mm). The total of the suds heights was recorded as the "suds" value; the total soil added was recorded as "mileage". In the table the ratio of values for the test samples and the comparative difference. Four replicates were made with each test composition, and there were four judges in the panel. The results are quoted in panel score units (psu), positive values indicating a preference for the composition of the invention. Results with an asterisk were not distinguishable at 95% confidence over the random error of the test.

Some of the above tested compositions had less than optimum viscosity to ensure commercially practical stability, that is freedom from settling of the undissolved inorganic salt. This could be corrected by small variations of the proportion of lower alcohol and "Aerosil" without significant effect upon the performance of the compositions.

What is claimed is:

1. A substantially non-aqueous liquid, pasty or gelatinous detergent composition having scouring properties comprising a dispersion of from about 19% to 79% of a water-miscible liquid medium selected from the group consisting of a. a liquid polyhydric alcohol and b. a mixture of a liquid polyhydric alcohol and a lower monohydric alcohol, wherein the amount of free water is not more than about 5% by weight and;

a. from about 15 to 74% of a normally solid water-soluble anionic surface-active agent selected from the group consisting of alkali metal, ammonium, and amine salts of organic sulfates and sulfonates;

b. from about 5 to 60% of a solid particulate water-soluble abrasive inorganic salt selected from the group consisting of chlorides, sesquicarbonates, sulfates, phosphates, carbonates, and borates, said inorganic salt having a particle size such that at least 90% by weight passes an 8 mesh Standard Test Sieve and is retained by a 100 mesh BS Standard Test Sieve, and c. from about 1 to about 5% by weight of a highly voluminous oxide suspending agent selected from the group consisting of silicas, magnesias, aluminas, clays and mixtures thereof effective to suspend said water-soluble inorganic salt throughout said composition.

2. The composition of claim 1 wherein the normally-solid and water-soluble anionic surface-active agent comprises a mixture of alkali metal alkylbenzene sulfonate where the alkyl has from 8 to 20 carbon atoms and alkali metal alkyl ether sulfate where the alkyl has from 8 to 20 carbon atoms and from 1 to 15 ethyleneoxy groups; the molar ratio of alkylbenzene sulfonate to alkyl ether sulfate being from 3:1 to 1:3.

3. The composition of claim 2 wherein the alkali metal alkyl benzene sulfonate is sodium dodecylbenzene sulfonate and the alkyl ether sulfate is sodium alkyl triethoxy sulfate.

4. The composition of claim 1 wherein the inorganic salt has a particle size such that at least 90% by weight passes a 10 mesh BS Standard Test Sieve and is retained by a 60 mesh BS Standard Test Sieve.

5. The composition of claim 1 wherein the solid particulate water-soluble inorganic salt is sodium chloride or sodium sesquicarbonate.

6. The composition of claim 1 wherein the suspending agent is a highly-voluminous silica.

7. The composition of claim 6 wherein the solid particulate water-soluble salt is selected from the group consisting of sodium chloride and sodium sesquicarbonate at from about 15 to 30% and a. the water-miscible liquid medium is present at from about 30 to 60%;

b. the normally solid water-soluble anionic surface active agent is present at from about 20 to 40%; and c. the silica is present at from about 1 to 3% wherein the amount of free water is not more than 4% by weight.

8. The composition of claim 7 wherein the water-miscible liquid medium comprises a mixture of glycerol and ethyl alcohol in ratio by weight in the range from 3:1 to 1:1.

9. A substantially non-aqueous liquid, pasty or gelatinous detergent composition having scouring properties comprising a dispersion of from about 25% to 90% of a water-miscible liquid medium selected from the group consisting of a. a liquid polyhydric alcohol and b. a mixture of a liquid polyhydric alcohol and a lower monohydric alcohol, wherein the amount of free water is not more than about 5% by weight and;

a. from about 1 to 15% of a normally solid watersoluble anionic surface-active agent selected from the group consisting of alkali metal, ammonium, and amine salts of organic sulfates and sulfonates;

b. from about 5 to 60% of a solid particulate water-soluble abrasive inorganic salt selected from the group consisting of chlorides, sesquicarbonates, sulfates, phosphates, carbonates, and borates, said inorganic salt having a particle size such that at least 90% by weight passes an 8 mesh Standard Test Sieve and is retained by a 100 mesh BS Standard Test Sieve, and c. from about 1 to about 5% by weight of a highly voluminous oxide suspending agent selected from the group consisting of silicas, magnesias, aluminas, clays and mixtures thereof effective to suspend said water-soluble inorganic salt throughout said composition.

10. The composition of claim 9 wherein the normally-solid and water-soluble anionic surface-active agent comprises a mixture of alkali metal alkylbenzene sulfonate where the alkyl has from 8 to 20 carbon atoms and alkali metal alkyl ether sulfate where the alkyl has from 8 to 20 carbon atoms and from 1 to 15 ethyleneoxy groups; the molar ratio of alkylbenzene sulfonate to alkyl ether sulfate being from 3:1 to 1:3.

11. The composition of claim 10 wherein the alkali metal alkyl benzene sulfonate is sodium dodecylbenzene sulfonate and the alkyl ether sulfate is sodium alkyl triethoxy sulfate.

12. The composition of claim 9 wherein the inorganic salt has a particle size such that at least 90% by weight passes a 10 mesh BS Standard Test Sieve and is retained by a 60 mesh BS Standard Test Sieve.

13. The composition of claim 9 wherein the solid particulate water-soluble inorganic salt is sodium chloride or sodium sesquicarbonate.

14. The composition of claim 9 wherein the suspending agent is a highly-voluminous silica.

15. The composition of claim 14 wherein the solid particulate water-soluble salt is selected from the group consisting of sodium chloride and sodium sesquicarbonate at from about 15 to 30% and a. the water-miscible liquid medium is present at from about 50 to 70%;

b. the normally solid water-soluble anionic surface active agent is present at from about 5 to 10%; and c. the silica is present at from about 1 to 3% wherein the amount of free water is not more than 4% by weight.

16. The composition of claim 15 wherein the water-miscible liquid medium comprises a mixture of glycerol and ethyl alcohol in ratio by weight in the range from 3:1 to 1:1.

* * * * *